US008772663B2

(12) United States Patent
Fukushima et al.

(10) Patent No.: US 8,772,663 B2
(45) Date of Patent: Jul. 8, 2014

(54) ROTARY ELECTRIC COMPONENT

(71) Applicant: Tokyo Cosmos Electric Co., Ltd., Kanagawa (JP)

(72) Inventors: Hajime Fukushima, Tokyo (JP); Taro Fukunaga, Kanagawa (JP)

(73) Assignee: Tokyo Cosmos Electric Co., Ltd., Kanagawa (JP)

( * ) Notice: Subject to any disclaimer, the term of this patent is extended or adjusted under 35 U.S.C. 154(b) by 0 days.

(21) Appl. No.: 13/951,484

(22) Filed: Jul. 26, 2013

(65) Prior Publication Data

US 2013/0299329 A1 Nov. 14, 2013

Related U.S. Application Data

(63) Continuation of application No. 13/258,444, filed as application No. PCT/JP2010/069085 on Oct. 27, 2010.

(30) Foreign Application Priority Data

Feb. 3, 2010 (JP) ..... 2010-021869

(51) Int. Cl.
*H01H 19/14* (2006.01)

(52) U.S. Cl.
USPC ..... 200/565; 338/162

(58) Field of Classification Search
USPC ..... 338/160–170; 200/337, 11 A, 565
See application file for complete search history.

(56) References Cited

U.S. PATENT DOCUMENTS

| | | | | |
|---|---|---|---|---|
| 4,855,541 | A | 8/1989 | Yamashita et al. | |
| 5,546,067 | A * | 8/1996 | Schmidt et al. | 338/172 |
| 5,927,486 | A | 7/1999 | Kamiya | |
| 6,310,535 | B2 * | 10/2001 | Kuratani | 338/162 |
| 6,374,696 | B1 | 4/2002 | Blake et al. | |
| 6,506,984 | B2 * | 1/2003 | Tomita | 338/162 |
| 7,030,324 | B2 | 4/2006 | Gotoh | |
| 7,262,373 | B2 * | 8/2007 | Miura et al. | 200/14 |
| 7,423,230 | B2 | 9/2008 | Yoritsune et al. | |

(Continued)

FOREIGN PATENT DOCUMENTS

| | | |
|---|---|---|
| JP | S52-017096 Y | 4/1977 |
| JP | 561-255578 A | 11/1986 |

(Continued)

OTHER PUBLICATIONS

Office Action issued on Mar. 8, 2010 for JP application No. 2010-021869.

*Primary Examiner* — Briggitte R Hammond
(74) *Attorney, Agent, or Firm* — Kubotera & Associates, LLC

(57) ABSTRACT

A click mechanism for an electric part comprises a spring 50 made of a plate material and disposed on a rotatable plate 40 that rotates integrally with a rotationally-manipulated shaft of an electric part, a click piece 60 disposed on the outer perimeter of the rotatable plate 40 so as to retractably protrude from the outer perimeter, and projections and depressions 25 formed on the inner perimeter of a housing 22 for the rotatable plate 40 to be arranged in the circumferential direction of the inner perimeter. The click piece 60 is cylindrical and biased by the spring 50 to be in resilient contact with the projections and depressions 25 at the perimeter thereof. The click mechanism can produce a fine and clear click feel, has high durability, and can be reduced in size.

10 Claims, 8 Drawing Sheets

(56) References Cited

U.S. PATENT DOCUMENTS

| | | | |
|---|---|---|---|
| 2001/0023145 | A1 | 9/2001 | Mito |
| 2001/0024156 | A1 | 9/2001 | Kuratani |
| 2008/0190752 | A1 | 8/2008 | Miyata et al. |

FOREIGN PATENT DOCUMENTS

| | | | |
|---|---|---|---|
| JP | H02-011701 | Y | 3/1990 |
| JP | H05-045858 | Y | 6/1993 |
| JP | H05-081926 | Y | 11/1993 |
| JP | H07-220576 | A | 8/1995 |
| JP | 2001-243849 | A | 9/2001 |
| JP | 2004-047990 | A | 2/2004 |
| JP | 2006-179394 | A | 7/2006 |
| JP | 2007-328974 | A | 12/2007 |

* cited by examiner

ROTARY ELECTRIC COMPONENT

CROSS-REFERENCE TO RELATED APPLICATIONS

This is a continuation application of application Ser. No. 13/258,444 filed Sep. 21, 2011, which is a national stage of PCT/JP2010/069085 filed Oct. 27, 2010, which claims priority to Japanese Application No. 2010-021869 filed Feb. 3, 2010, the entire contents of which are incorporated by reference herein.

TECHNICAL FIELD

The present invention relates to a click mechanism that produces a click feel (a tactile response) during manipulation of a rotatable or slidable electric part.

BACKGROUND ART

Conventional click mechanisms of this kind use balls and coil springs as described in Patent literatures 1 and 2, for example.

FIG. 1 shows an arrangement of a switch case and a movable plate of a rotary switch provided with the click mechanism described in Patent literature 1. In FIG. 1, reference numeral 1 denotes a switch case, reference numeral 2 denotes a manipulation shaft that is to be rotationally manipulated, and reference numeral 3 denotes a movable plate fixed to the manipulation shaft 2. Reference numeral 4 denotes a movable contact to come into contact with a fixed contact (not shown), and reference numeral 5 denotes a coil spring for biasing the movable contact 4 to the fixed contact and biasing the movable plate 3 to the inner top wall surface of the switch case 1.

The click mechanism comprises a groove 1*a* formed in the inner perimeter of the switch case 1 and two balls 6 and two coil springs 7 fitted in the outer perimeter of the movable plate 3 at two sites. The coil springs 7 bias the balls 6 to the inner perimeter of the switch case 1 to engage the balls 6 in the groove 1 a, thereby producing a click feel.

PRIOR ART LITERATURE

Patent Literature

Patent literature 1: Japanese examined utility model Publication No. H2-11701

Patent literature 2: Japanese examined utility model Publication No. S52-17096

SUMMARY OF THE INVENTION

Problems to be Solved by the Invention

In the structure in which balls come into resilient contact with a projection on or depression in the counterpart housing, such as that in the example of prior art described above, the balls come into point contact with the projection or depression. As a result, the housing locally wears, so that there is a problem of durability.

In addition, in an electric part, such as a switch whose manipulation shaft is rotationally manipulated, a high torque (step torque) is required to produce a clear click feel. However, producing a high torque requires a coil spring of a large wire diameter. As a result, the coil spring has a larger outer diameter, so that it is difficult to reduce the size of the electric part.

At present, rotationally-manipulated switches used in portable electronic devices are required to have a smaller size and a bigger manipulation knob. Thus, there is a demand for a click mechanism capable of producing a clear click feel and producing a high torque to avoid accidental rotation.

In view of such circumstances, an object of the present invention is to provide a click mechanism for an electric part that can produce a fine and clear click feel and has a small size and a high durability.

Means to Solve the Problems

According to a first aspect of the present invention, a click mechanism for an electric part that has a rotationally-manipulated shaft comprises: a spring that is made of a plate material or line material and disposed on a rotatable plate that rotates integrally with the rotationally-manipulated shaft; a click piece disposed on an outer perimeter of the rotatable plate so as to retractably protrude from the outer perimeter; and a projection and depression formed on an inner perimeter of a housing for the rotatable plate to be arranged in a circumferential direction of the inner perimeter, in which the click piece is cylindrical and is biased by the spring to be in resilient contact with the projection and depression at a perimeter thereof.

According to a second aspect of the present invention, a click mechanism for an electric part that has a rotationally-manipulated shaft comprises: a projection and depression formed on an outer perimeter of a rotatable plate to be arranged in a circumferential direction of the outer perimeter, the rotatable plate rotating integrally with the rotationally-manipulated shaft; a click piece disposed on a housing for the rotatable plate so as to retractably protrude from an inner perimeter of the housing; and a spring that is made of a plate material or line material and disposed on the housing, in which the click piece is cylindrical and is biased by the spring to be in resilient contact with the projection and depression at a perimeter thereof.

According to a third aspect of the present invention, a click mechanism for an electric part that has a slidable manipulation knob comprises: a spring that is made of a plate material or line material and disposed on a movable body that slides integrally with the slidable manipulation knob; a click piece disposed on a perimeter of the movable body so as to retractably protrude from the perimeter; and a projection and depression formed on an inner wall surface of a recess of a housing in which the movable body is slidably housed to be arranged in a sliding direction of the movable body, in which the click piece is cylindrical and is biased by the spring to be in resilient contact with the projection and depression at a perimeter thereof.

Effects of the Invention

According to the present invention, a cylindrical click piece and a spring made of a plate material or line material are used. Compared with a conventional click mechanism that uses a ball and a coil spring, the click mechanism according to the present invention can be reduced in size and at the same time can produce high force and a fine and clear click feel.

Unlike the conventionally used ball that provides point contact, the cylindrical click piece provides line contact, so that wearing of the counterpart housing can be reduced. Thus, the click mechanism has high durability.

DETAILED DESCRIPTION OF THE EMBODIMENTS

In the following, an embodiment of the present invention will be described.

Figure 1:
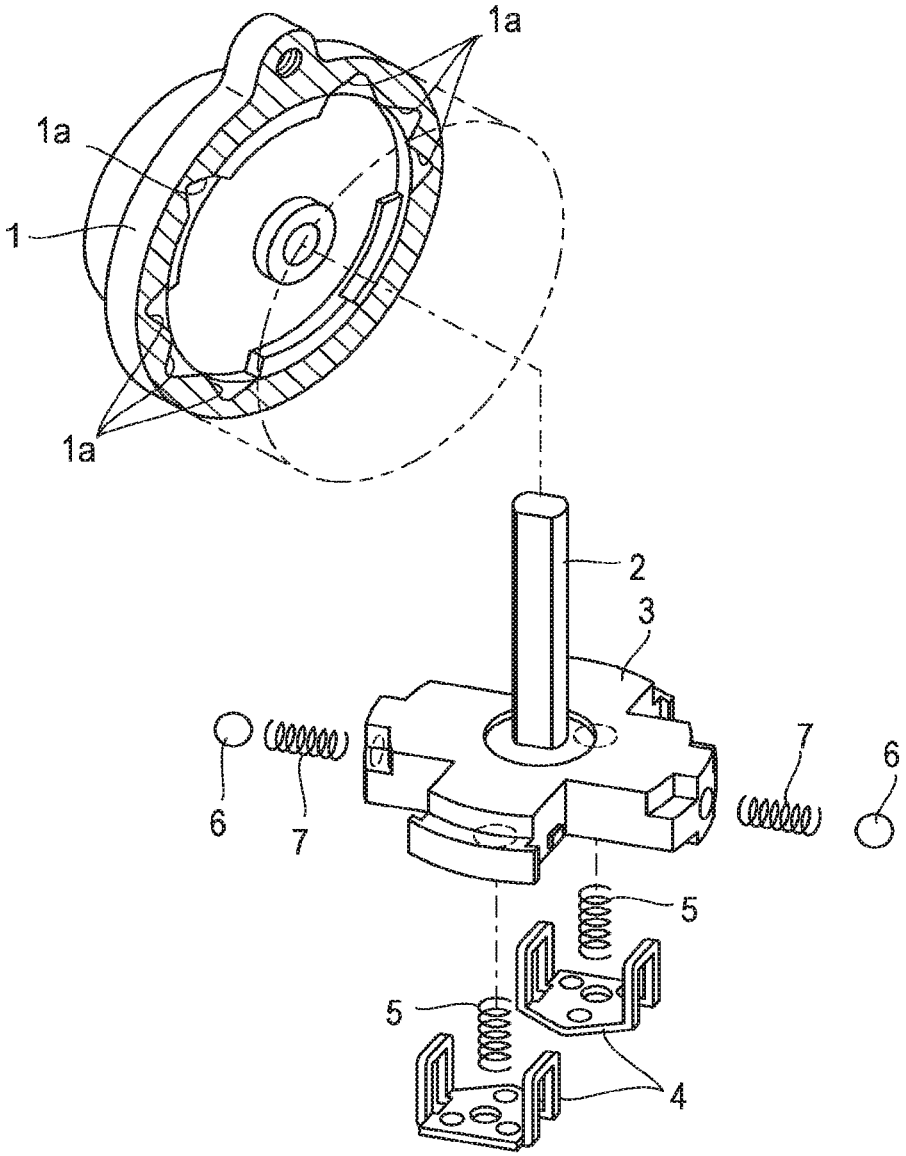
FIG. 1 Prior Art
FIG. 1 is a diagram for illustrating a conventional click mechanism.
Figure 2:
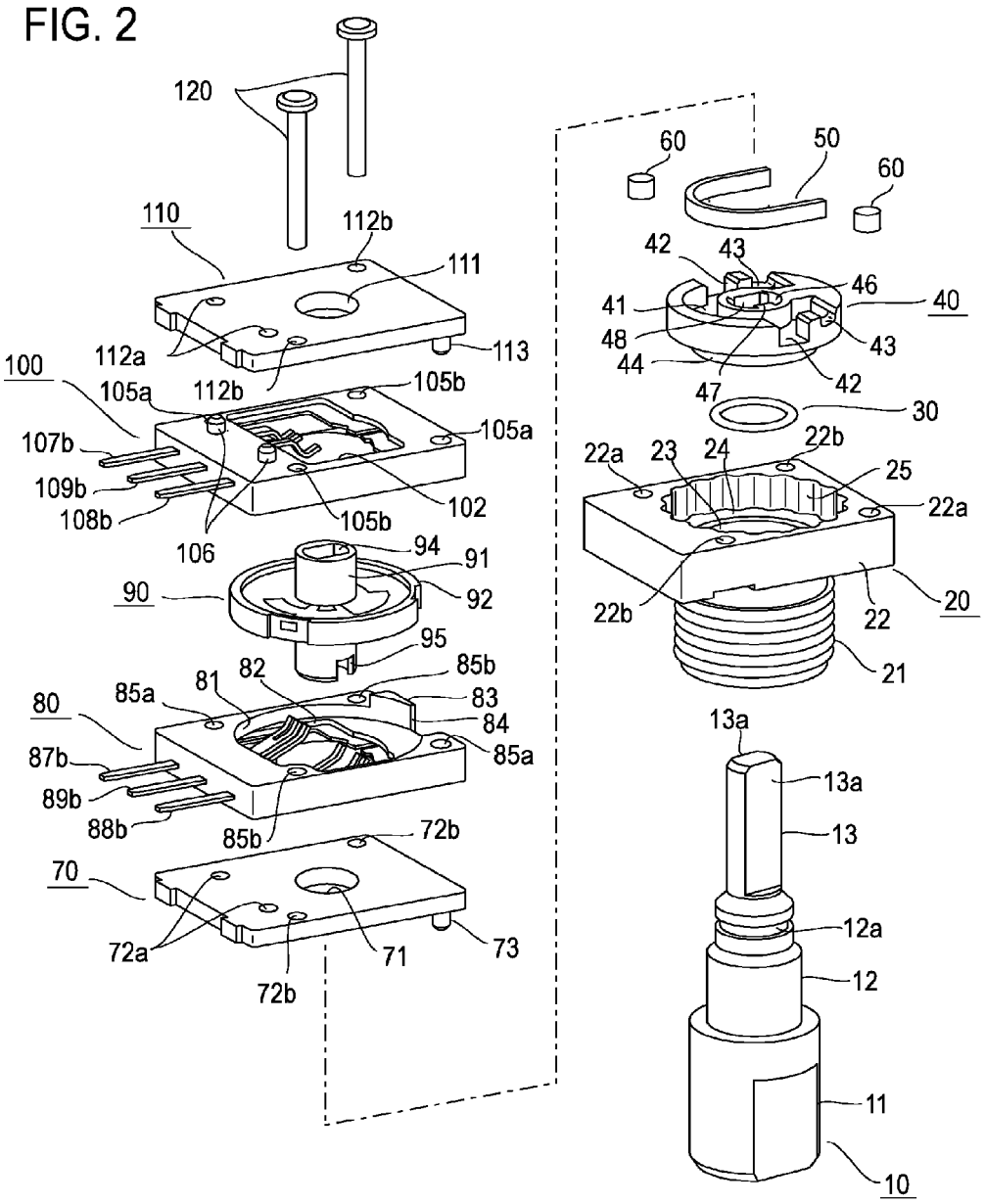
FIG. 2 is an exploded perspective view of a switch provided with a click mechanism according to an embodiment of the present invention.

FIG. 2 is an exploded view showing an arrangement of a rotationally-manipulated switch, which is an example of an electric part provided with a click mechanism according to the present invention. The switch comprises a rotationally-manipulated shaft 10, a bearing 20, a ring 30, a rotatable plate 40, a spring 50, a click piece 60, an intermediate plate 70, a lower contact element holder 80 that holds a contact element, a rotor 90, an upper contact element holder 100 that holds a contact element, a cover 110, and a rivet 120.

The rotationally-manipulated shaft 10 has a manipulating part 11, a holding part 12 having a smaller diameter than the manipulating part 11 that coaxially extends from the tip of the manipulating part 11, and a driving part 13 having a smaller diameter than the holding part 12 that coaxially extends from the tip of the holding part 12. An annular groove 12*a* is formed in the outer perimeter of the holding part 12 at a site close to the tip end thereof. The driving part 13 has two parallel flat surfaces 13*a* that are formed by cutting away the driving part 13 in parallel to the central axis thereof. The rotationally-manipulated shaft 10 is made of resin or metal.

The bearing 20 has an attachment part 21 having an attachment thread formed in the outer perimeter, and a rectangular housing part 22 formed integrally with the attachment part 21 at one end of the attachment part 21. The attachment part 21 has a shaft hole 23 at the center thereof in which the holding part 12 of the rotationally-manipulated shaft 10 is rotatably inserted. The housing part 22 has a circular recess 24 formed coaxially with the shaft hole 23 on the side of the upper surface thereof (on the side opposite to the surface close to the attachment part 21), and the shaft hole 23 opens into the bottom surface of the recess 24. The inner perimeter of the recess 24 has protrusions and depressions 25 formed with a predetermined pitch in the circumferential direction. The housing part 22 has positioning holes 22*a* formed in the upper surface at a pair of diagonally opposite corners and fixing holes 22*b* formed in the upper surface at the other pair of diagonally opposite corners. The bearing 20 is made of resin or metal.

The rotatable plate 40 has a circular shape and is made of resin or metal. A substantially U-shaped recess 41 is formed in the upper surface of the rotatable plate 40. In addition, notches 42 that are in communication with the U-shaped recess 41 and extend to the outer perimeter of the rotatable plate 40 are formed at the leg parts of the U-shaped recess 41, and notches 43 shallower than the notches 42 are formed at the leg parts of the U-shaped recess 41 at sites closer to the ends of the leg parts than the notches 42. The bottom surface of the recess 41 and the bottom surfaces of the notches 42 are flush with each other.

The rotatable plate 40 has a shaft part 44 that is to be inserted in the shaft hole 23 of the bearing 20 on the lower surface. Although not shown in FIG. 2, the shaft part 44 has a shaft hole 45 in which the driving part 13 of the rotationally-manipulated shaft 10 is inserted (see FIGS. 5A and 5B). On the side of the upper surface of the rotatable plate 40, the shaft part 44 also has a shaft hole 46 that has a larger diameter than the shaft hole 45 and is in communication with the shaft hole 45. An engaging key 47, which protrudes from one site toward the center of the shaft hole 46 and extends in the axial direction, is formed on the inner perimeter of the shaft hole 46. A protrusion part 48, which has a shape conforming to the shape of one of the flat surfaces 13*a* of the driving part 13 of the rotationally-manipulated shaft 10, is formed on the inner perimeter of the shaft hole 46 at a site opposite to the engaging key 47. The shaft hole 46 has a diameter large enough to insert a rotary shaft 91 of the rotor 90 described later in the shaft hole 46.

The spring 50 has a U-shape and is formed by bending a metal plate having a small width into a U shape.

The click piece 60 has the shape of a short cylinder, and two click pieces 60 are used in this example. The click pieces 60 are made of metal or resin.

The intermediate plate 70 has the same rectangular shape as the housing part 22 of the bearing 20 and has a shaft hole 71 formed at the center thereof. The shaft hole 71 has a diameter large enough to rotatably insert the rotary shaft 91 of the rotor 90 described later in the shaft hole 71. The intermediate plate 70 has two positioning holes 72*a* formed at adjacent sites along one side thereof, fixing holes 72*b* formed at a pair of diagonally opposite corners thereof, and positioning protrusions 73 formed on the lower surface at the other pair of diagonally opposite corners thereof. Note that FIG. 2 does not show one of the positioning protrusions 73 that is hidden behind the intermediate plate 70. The intermediate plate 70 is made of resin, for example.

Figure 3A:
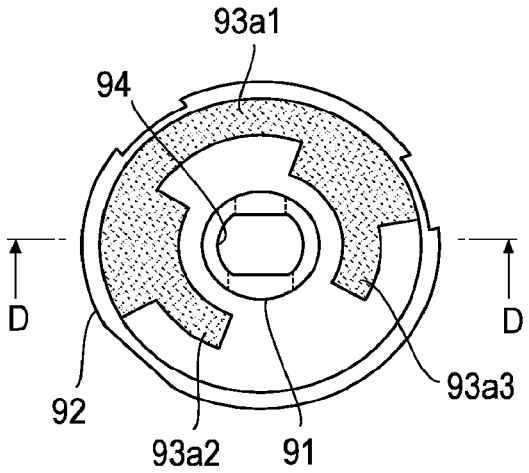
FIG. 3A is a plan view of a rotor shown in FIG. 2.
Figure 3B:
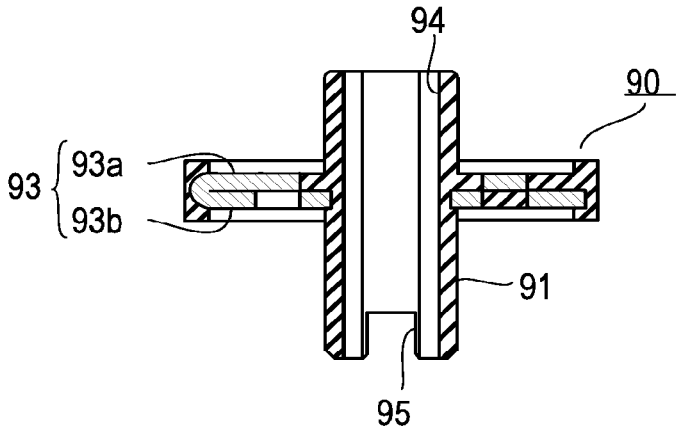
FIG. 3B is a cross-sectional view taken along the line D-D in FIG. 3A.
Figure 3C:
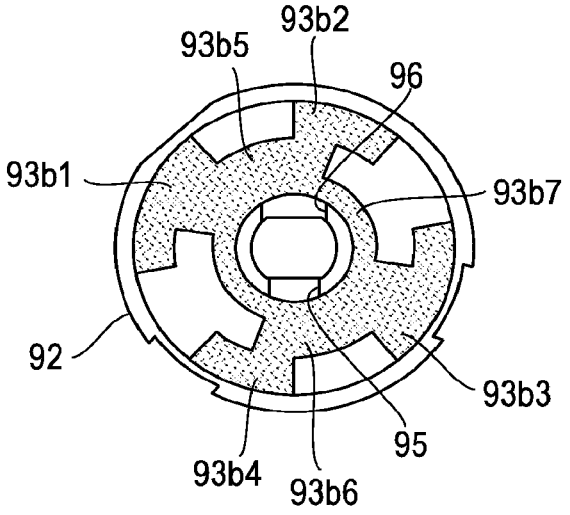
FIG. 3C is a bottom view of the rotor shown in FIG. 2.

FIGS. 3A, 3B and 3C show the rotor 90 in detail. FIG. 3A is a plan view, FIG. 3B is a cross-sectional view taken along the line D-D in FIG. 3A, and FIG. 3C is a bottom view.

The rotor 90 comprises a rotary shaft 91, a disk part 92 located coaxially with the rotary shaft 91 at a middle point along the length of the rotary shaft 91, and a slidable contact piece 93 held in the disk part 92, which are integrally formed by insert molding. Note that the slidable contact piece 93 is shaded in FIGS. 3A and 3C.

The rotary shaft 91 has a shaft hole 94 that is to be engaged with the driving part 13 of the rotationally-manipulated shaft 10. The rotary shaft 91 also has, at the lower end thereof, notches 95 and 96 that are to be engaged with the engaging key 47 and the protrusion part 48 of the rotatable plate 40, respectively. The notches 95 and 96 have a predetermined length in the axial direction so that the rotary shaft 91 is inserted in the shaft hole 46 of the rotatable plate 40 over the length of the notches 95 and 96 in the axial direction.

The slidable contact piece 93 comprises an upper contact piece 93*a* and a lower contact piece 93*b*, which are formed by punching from one metal plate and bending as shown in FIG. 3B. The upper contact piece 93*a* and the lower contact piece 93*b* are overlaid one on another.

As shown in FIG. 3A, the upper contact piece 93*a* has two concentric annular regions, each of which includes an arc-shaped contact region (exposed region). In the outer annular region, one contact region 93*a*1 extending over a predetermined angular range is formed. In the inner annular region, two contact regions 93*a*2 and 93*a*3 each extending over a predetermined angular range are formed.

On the other hand, the lower contact piece 93*b* has two annular regions which are the same as (that is, which have the same diameters as) the two annular regions of the upper contact piece 93*a* and an annular region adjacent to the two annular regions on the inner side thereof. In the outermost annular region, four contact regions 93*b*1, 93*b*2, 93*b*3 and 93*b*4 each extending over a predetermined angular range are formed. In the intermediate annular region, two contact regions 93*b*5 and 93*b*6 each extending over a predetermined angular range are formed. In the innermost annular region, an annular contact region 93*b*7 (extending over 360.degree.) is formed.

Figure 4A:
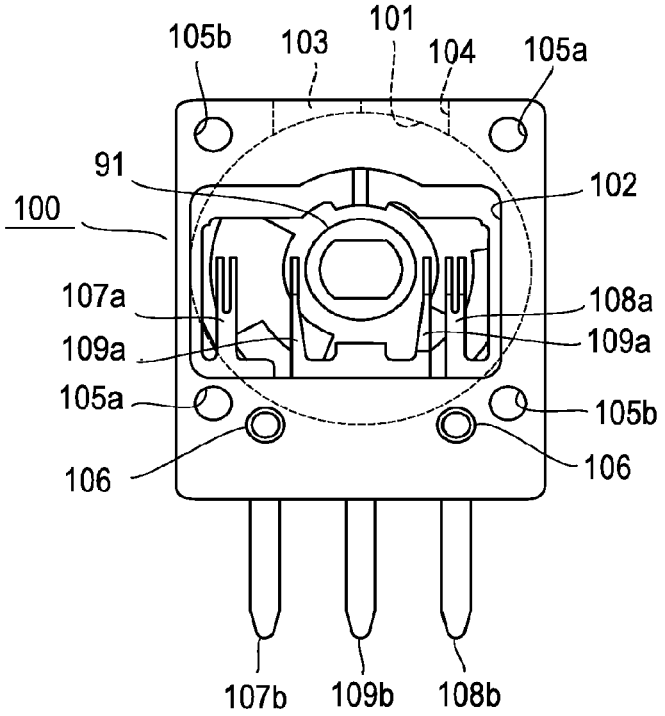
FIG. 4A is a plan view of an upper contact element holder shown in FIG. 2 and the rotor positioned under the upper contact element holder.

FIG. 4A shows the upper surface of the upper contact element holder 100 and the upper surface of the rotor 90 assembled and positioned under it.

The upper contact element holder 100 having the same rectangular shape as the housing part 22 has a circular rotor housing recess 101 in the lower surface thereof, and a substantially rectangular window 102 is formed in the top of the rotor housing recess 101. The upper contact element holder 100 also has an engaging protrusion 103 on and an engaging recess 104 in a side wall part of the rotor housing recess 101, which is adjacent to one side of the upper contact element holder 100. The engaging protrusion 103 is formed so as to project from the bottom of the side wall toward the lower contact element holder 80, and the engaging recess 104 is formed adjacent to the engaging protrusion 103 so as to have the same width as the engaging protrusion 103. Positioning holes 105*a* are formed in the upper contact element holder 100 at a pair of diagonally opposite corners, and fixing holes 105*b* are formed at the other pair of diagonally opposite corners. Furthermore, two positioning protrusions 106 are formed at sites close to a side of the upper contact element holder 100 from which terminals 107*b*, 108*b* and 109*b* are drawn to the outside.

The upper contact element holder 100 is formed by insert molding with three contact elements 107*a*, 108*a* and 109*a* and the terminals 107*b*, 108*b* and 109*b*, which integrally extend from the three contact elements 107*a*, 108*a* and 109*a*, respectively, and project from the one side of the upper contact element holder 100 to the outside. The three contact elements 107*a*, 108*a* and 109*a* extend inwardly from the edge of the window 102, and the tip ends thereof are located over the three annular regions defined on the slidable contact piece 93 of the rotor 90. In this example, each contact element 107*a*, 108*a*, 109*a* has two branch arms and is in contact with the corresponding annular region at two points and thus is improved in contact stability (reliability) and life time.

Figure 4B:
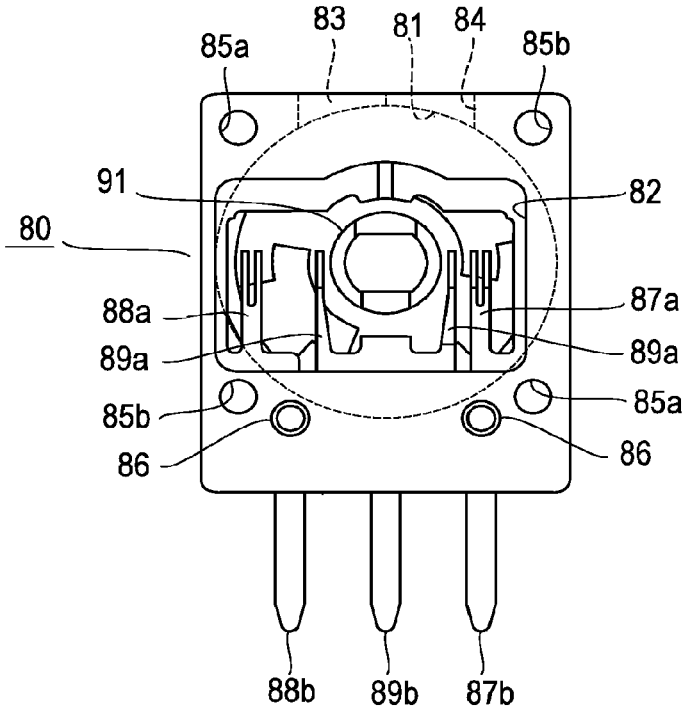
FIG. 4B is a bottom view of a lower contact element holder shown in FIG. 2 and the rotor positioned on the lower contact element holder.

FIG. 4B shows the lower surface of the lower contact element holder 80 and the lower surface of the rotor 90 assembled and positioned on it.

The lower contact element holder 80 has the same structure as the upper contact element holder 100. Thus, one contact element holder can be used as the upper contact element holder 100 or the lower contact element holder 80 by turning the contact element holder upside down.

The lower contact element holder 80 has a circular rotor housing recess 81 in the upper surface thereof, and a substantially rectangular window 82 is formed in the bottom of the rotor housing recess 81. The lower contact element holder 80 also has an engaging protrusion 83 on and an engaging recess 84 in a side wall part of the rotor housing recess 81, which is adjacent to one side of the lower contact element holder 80. The engaging protrusion 83 is formed so as to project from the bottom of the side wall toward the upper contact element holder 100, and the engaging recess 84 is formed adjacent to the engaging protrusion 83 so as to have the same width as the engaging protrusion 83. Positioning holes 85*a* are formed in the lower contact element holder 80 at a pair of diagonally opposite corners, and fixing holes 85*b* are formed at the other pair of diagonally opposite corners. Furthermore, two positioning protrusions 86 are formed at sites close to a side of the lower contact element holder 80 from which terminals 87*b*, 88*b* and 89*b* are drawn to the outside.

The lower contact element holder 80 is formed by insert molding with three contact elements 87*a*, 88*a* and 89*a* and the terminals 87*b*, 88*b* and 89*b*, which integrally extend from the three contact elements 87*a*, 88*a* and 89*a*, respectively, and project from the one side of the lower contact element holder 80 to the outside. The three contact elements 87*a*, 88*a* and 89*a* extend inwardly from the edge of the window 82, and the tip ends thereof are located over the three annular regions defined on the slidable contact piece 93 of the rotor 90. Each contact element 87*a*, 88*a*, 89*a* has two branch arms and is in contact with the corresponding annular region at two points.

The cover 110 has the same shape as the intermediate plate 70 and has a shaft hole 111, two positioning holes 112*a*, two fixing holes 112*b* and two positioning protrusions 113 as with the intermediate plate 70. The cover is made of resin, for example.

The parts are assembled as described below.

The rotationally-manipulated shaft 10 is inserted in the bearing 20, and the ring 30 is fitted in the annular groove 12*a* formed at the tip end part of the holding part 12 to prevent the rotationally-manipulated shaft 10 from dropping off.

The rotatable plate 40 is housed in the recess 24 of the housing part 22 of the bearing 20 with the driving part 13 of the rotationally-manipulated shaft 10 inserted in the shaft hole 45 of the shaft part 44 and the shaft hole 46 in communication with the shaft hole 45. In this state, the spring 50 is housed and placed in the recess 41 of the rotatable plate 40 (see FIGS. 5A and 5B described later). The spring 50 can be easily fitted in the recess 41 by holding the spring 50 at the opposite ends with a pair of tweezers to narrow the U shape. The notches 43 of the rotatable plate 40 serve as escapes for the tweezers.

Then, the two click pieces 60 are housed and placed in the two notches 42 of the rotatable plate 40. The click pieces 60 are pressed into the notches 42 defined by the spring 50 and the inner perimeter of the recess 24.

The intermediate plate 70 is attached to the upper surface of the housing part 22 to cover the top of the recess 24 of the housing 22 housing the rotatable plate 40 with the driving part 13 inserted in the shaft hole 71. At the same time, the positioning protrusions 73 of the intermediate plate 70 are fitted in the positioning holes 22*a* of the housing 22.

The positioning protrusions 86 of the lower contact element holder 80 is fitted in the positioning holes 72*a* of the intermediate plate 70, thereby positioning and fixing the lower contact element holder 80 on the intermediate plate 70. Then, from above, the lower end part of the rotary shaft 91 is inserted in and engaged with the shaft hole 46 of the rotatable plate 40 through the shaft hole 71 of the intermediate plate 70 while inserting the driving part 13 of the rotationally-manipulated shaft 10 in the shaft hole 94 of the rotor 90 so that substantially the lower half of the disk part 92 of the rotor 90 is placed in the rotor housing recess 81 of the lower contact element holder 80.

Then, the upper contact element holder 100 is placed and fixed on the lower contact element holder 80 to cover the rotor 90 from above so that substantially the upper half of the disk part 92 of the rotor 90 is housed in the rotor housing recess 101 of the upper contact element holder 100. In this process, the engaging protrusion 103 and the engaging recess 104 of the upper contact element holder 100 are engaged with the engaging recess 84 and the engaging protrusion 83 of the lower contact element holder 80, respectively, and positioned with respect to each other.

Then, the cover 110 is overlaid on the upper contact element holder 100 by inserting the upper end part of the rotary shaft 91 of the rotor 90 in the shaft hole 111 of the cover 110 and fitting the positioning protrusions 113 in the positioning holes 105*a* and the positioning protrusions 106 in the positioning holes 112*a*. In this way, the contact elements 87*a*, 88*a* and 89*a* of the lower contact element holder 80 come into resilient contact with the lower surface of the disk part 92 of the rotor 90, and the contact elements 107*a*, 108*a* and 109*a* of the upper contact element holder 100 come into resilient contact with the upper surface of the disk part 92 of the rotor 90.

With the parts assembled in this way, the two rivets 120 are inserted in the fixing holes 112*b* of the cover 110, the fixing holes 105*b* of the upper contact element holder 100, the fixing holes 85*b* of the lower contact element holder 80, the fixing holes 72*b* of the intermediate plate 70, and the fixing holes 22*b* of the bearing 20, and the tip ends of the rivets 120 are crimped, thereby integrating the parts and fixing them to each other to complete the switch.

In the switch arranged as described above, in response to rotation of the rotationally-manipulated shaft 10, the rotatable plate 40 and the rotor 90 integrally rotate, and the upper contact piece 93*a* and the lower contact piece 93*b* of the rotor 90 are connected to or disconnected from the contact elements 107*a*, 108*a* and 109*a* of the upper contact element holder 100 and the contact elements 87*a*, 88*a* and 89*a* of the lower contact element holder 80 depending on the angle of the rotation to produce a required switch open/close signal.

Figure 5A:
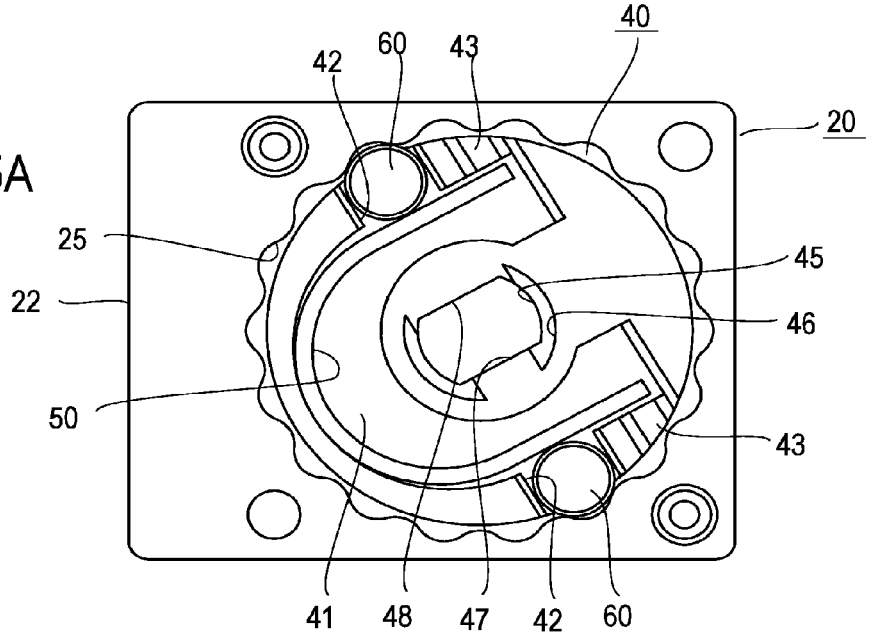
FIG. 5A is a plan view of a click mechanism shown in FIG. 2.
Figure 5B:
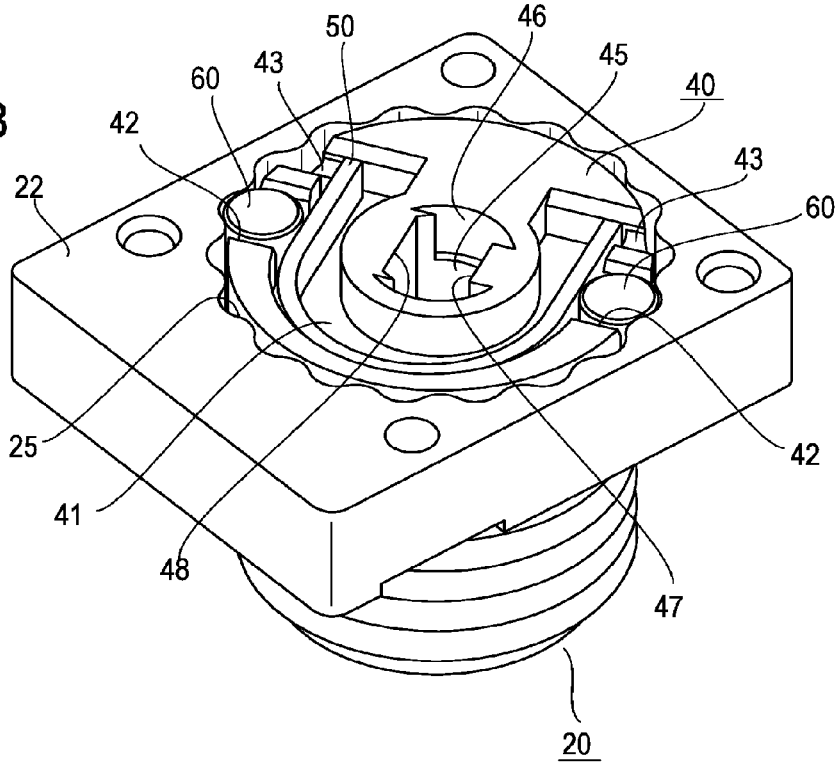
FIG. 5B is a perspective view of the click mechanism shown in FIG. 2.

The two click pieces 60 that are placed in the notches 42 in the outer perimeter of the rotatable plate 40 and retractably protrude from the outer perimeter are biased in the opposite directions by the leg parts of the U-shaped spring 50, and are pressed against and in resilient contact with, at the perimeter thereof, the projections and depressions 25 formed on the inner perimeter of the recess 24 of the flange part 22 of the bearing 20. This arrangement is shown in FIGS. 5A and 5B, in which illustration of the rotationally-manipulated shaft is omitted.

In the following, a click mechanism of this switch will be described with reference to FIGS. 5A and 5B.

When the rotatable plate 40 rotates as the rotationally-manipulated shaft 10 rotates, the click pieces 60 also rotate with the rotatable plate 40. At this time, the click pieces 60 move along the projections and depressions 25 formed on the inner perimeter of the recess 24 of the housing 22 of the bearing 20. In other words, the click pieces 60 alternately project from and are refracted into the rotatable plate 40, thereby producing a click feel. Since the click pieces 60 are simply pressed against the inner perimeter with the projections and depressions 25 by the spring 50, the click pieces 60 themselves independently rotate (spin) while moving along the inner perimeter of the recess 24.

As described above, the cylindrical click pieces 60 used in this example rotate in the same manner as the balls used in the conventional mechanism and therefore can produce as fine a click feel as the balls. In addition, the click mechanism in this example has the following advantages over the conventional click mechanism using balls and coil springs.

Since the click pieces are cylindrical, the click mechanisms are in line contact with the inner perimeter of the housing. Therefore, compared with the balls that are in point contact with the inner perimeter of the housing, wearing of the housing can be reduced, and thus, the durability can be improved.

Since the click pieces are cylindrical, the click pieces can have a smaller dimension in the axial direction (length) than the balls while maintaining the same dimension in the radial direction (diameter) as the balls. Accordingly, the thickness of the rotatable plate holding the click pieces can be reduced to reduce the size of the click mechanism. This contributes to the downsizing of the electric part.

The plate spring used in this example allows reduction of the dimension of the rotatable plate in the axial direction compared with the coil spring and at the same time can produce high torque.

Although a U-shaped plate spring is used to bias the click pieces in the example described above, the present invention is not limited to such a spring, and other springs such as those shown in FIGS. 6A, 6B, 6C and 7A can be used, for example.

Figure 6A:
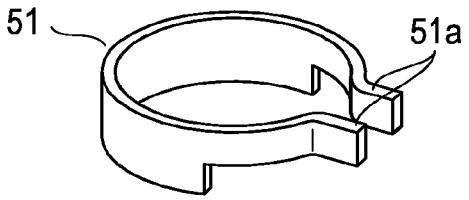
FIG. 6A is a perspective view showing another example of the shape of a spring.

A spring 51 shown in FIG. 6A is made of a plate material and has the shape of a ring having an opening and widened partially to produce high torque.

Figure 6B:
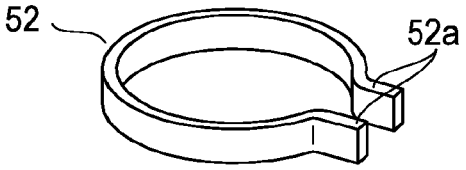
FIG. 6B is a perspective view showing another example of the shape of the spring.

A spring 52 shown in FIG. 6B is basically the same as the spring 51 shown in FIG. 6A except that the widened part is removed.

Figure 6C:
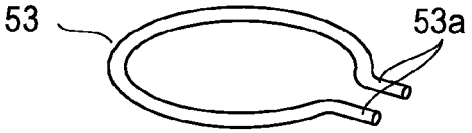
FIG. 6C is a perspective view showing another example of the shape of the spring.

A spring 53 shown in FIG. 6C is made of a line material rather than the plate material and is formed by bending the line material into a ring shape as with the spring 52 shown in FIG. 6B.

Figure 6D:
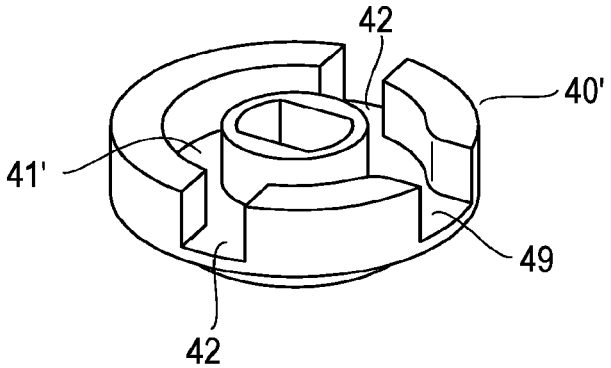
FIG. 6D is a perspective view showing the shape of a rotatable plate suitable for the springs shown in FIGS. 6A, 6B and 6C.

FIG. 6D shows a shape of a rotatable plate 40' in which the ring-shaped spring 51, 52 or 53 with an opening is housed and placed. In this example, the rotatable plate 40' has an annular recess 41' for housing the spring, two notches 42 in which the click pieces 60 are placed, and a notch 49 that is in communication with the recess 41' and extends to the outer perimeter of the rotatable plate 40'.

The ring-shaped spring 51, 52, 53 with an opening has extension parts 51*a*, 52*a*, 53*a* protruding outwardly at the opening, and the notch 49 houses the extension parts 51*a*, 52*a* or 53*a*. In assembly of the spring 51 (52, 53) to the rotatable plate 40', the spring can be easily fitted into the recess 41' by holding the pair of extension parts 51*a* (52*a*, 53*a*) with a pair of tweezers to narrow the ring, for example. In this process, the notch 49 serves as an escape for the tweezers. In the case of using the spring 51, 52 or 53, the two click pieces 60 are biased in the opposite directions by the halves of the ring on the opposite sides of the opening. In the case of using the spring 51, a groove for accommodating the widened part is formed in the bottom surface of the recess 41'.

Figure 7A:
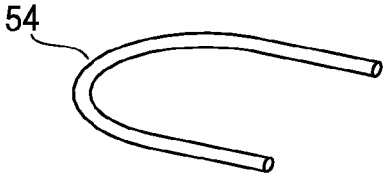
FIG. 7A is a perspective view showing another example of the shape of the spring.
Figure 7B:
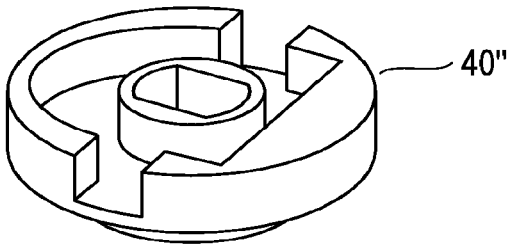
FIG. 7B is a perspective view showing the shape of the rotatable plate suitable for the spring shown in FIG. 7B.

A spring 54 shown in FIG. 7A has a U shape as with the spring 50 but is made of a line material rather than the plate material. FIG. 7B shows a rotatable plate 40" for housing the spring 54.

As described above, the spring for biasing the click pieces 60 can be made of a line material rather than the plate material and can have a ring shape rather than the U shape.

Figure 8:
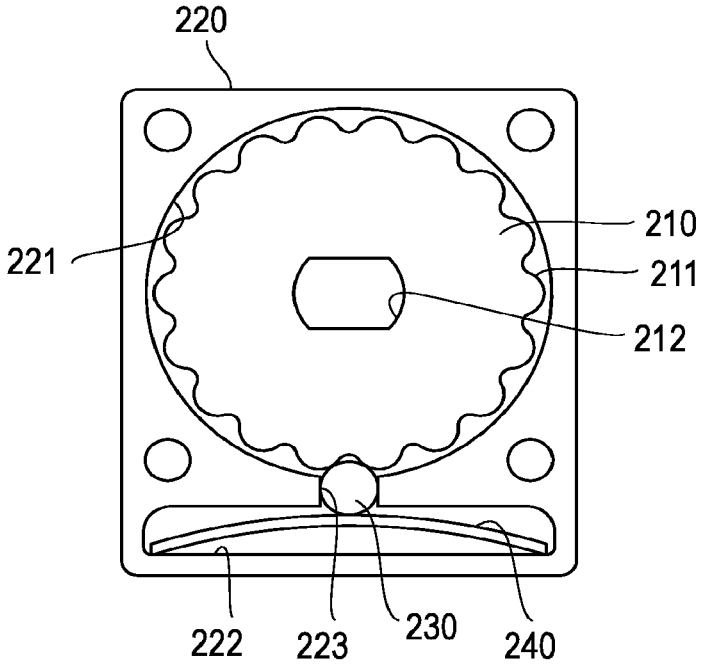
FIG. 8 is a diagram for illustrating a click mechanism according to another embodiment of the present invention.

Next, a click mechanism according to an embodiment of the present invention shown in FIG. 8 will be described.

In this embodiment, the outer perimeter of a rotatable plate 210 that rotates integrally with the rotationally-manipulated shaft has projections and depressions 211 formed in the circumferential direction, and a cylindrical click piece 230 and a spring 240 are disposed on a housing 220.

The rotatable plate 210 has a shaft hole 212 in which the rotationally-manipulated shaft is inserted and is rotatably housed in a circular recess 221 of the housing 220. The spring 240 is formed by bending a plate spring material into an arc shape and is housed in a recess 220 adjacent to the circular recess 221 of the housing 220.

The circular recess 221 and the recess 222 of the housing 220 communicate with each other via a groove 223 formed therebetween, and the click piece 230 is placed in the groove 223. The click piece 230 retractably protrudes from the inner perimeter of the circular recess 221 and the inner wall surface of the recess 222. The click piece 230 is biased by the spring 240 and in resilient contact with, at the perimeter thereof, the projections and depressions 211 on the outer perimeter of the rotatable plate 210.

In this embodiment, unlike the click mechanism shown in FIGS. 5A and 5B, the click piece 230 and the spring 240 are disposed on the fixed side (on the side of the housing). Depending on the structure of the electric part, such a click mechanism can also be used.

Figure 9A:
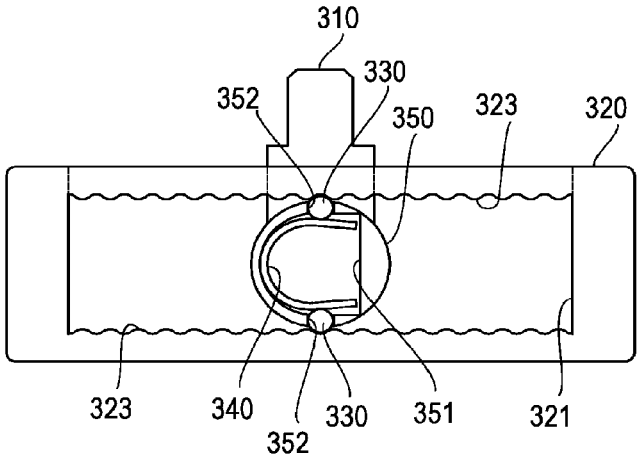
FIG. 9A is a diagram for illustrating a click mechanism according to an embodiment of the present invention suitable for an electric part that has a slidable manipulation knob.
Figure 9B:
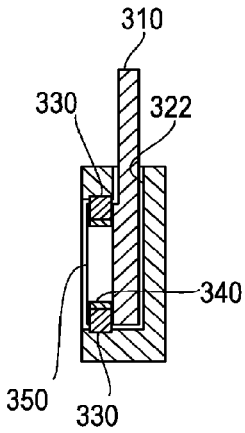
FIG. 9B is a central vertical cross-sectional view of the click mechanism shown in FIG. 9A.

Although click mechanisms for electric parts having a rotationally-manipulated shaft have been described, click mechanisms according to the present invention can be equally applied to direct-acting electric parts having a slidable manipulation knob. FIGS. 9A and 9B show such an arrangement. In FIGS. 9A and 9B, reference numeral 310 denotes a slidable manipulation knob, and reference numeral 320 denotes a housing.

Cylindrical click pieces 330 and a U-shaped spring 340 made of a plate spring material are disposed in a movable body 350. The movable body 350 is integrally formed with the slidable manipulation knob and slides integrally with the slidable manipulation knob 310. In this example, the movable body 350 has a circular disk shape and has a recess 351 in one surface thereof and notches 352 extending in the radially opposite directions from the recess 351 to the outer perimeter.

The spring 340 is housed and placed in the recess 351 of the movable body 350, and the two click pieces 330 are placed in the notches 352 in the perimeter of the movable body 350. The click pieces 330 retractably protrude from the perimeter of the movable body 350.

The housing 320 has a rectangular recess 321 in which the movable body 350 is slidably housed and an elongated opening 322 communicating with a bottom part of the recess 321 formed in a surface adjacent to the surface of the housing 320 in which the recess 321 is formed. The movable body 350 is placed in the recess 321, and the slidable manipulation knob 310 protrudes outwardly through the opening 322 and is slidable in the longitudinal direction of the opening 322.

Projections and depressions 323 are formed on the inner wall surfaces of the recess 321 extending in the sliding direction of the movable body 350 that slides with the slidable manipulation knob 310, and the two click pieces 330 are biased by the spring 340 in the opposite directions and are in resilient contact with the projections and depressions 323.

In this example, the arrangement described above produces a click feel as the slidable manipulation knob 310 slides. Although not shown in FIGS. 9A and 9B, a switch, a variable resistor or the like that operates in response to operation of the slidable manipulation knob 310 is disposed on the side of the recess 321 of the housing 320, and a movable part thereof is configured to slide with the movable body 350.

Figure 10A:
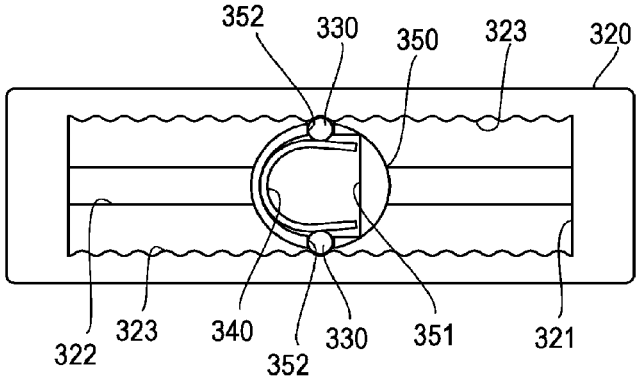
FIG. 10A is a diagram showing a modification of the embodiment shown in FIG. 9A in which the slidable manipulation knob protrudes in a different direction.
Figure 10B:
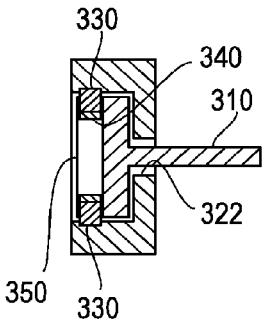
FIG. 10B is a central vertical cross-sectional view of the click mechanism shown in FIG. 10A.

FIGS. 10A and 10B show an exemplary arrangement that differs from the arrangement shown in FIGS. 9A and 9B in that the slidable manipulation knob 310 protruding outwardly in a different direction. Such an arrangement can also be used. In FIGS. 10A and 10B, the same parts as those in FIGS. 9A and 9B are denoted by the same reference numerals.

The invention claimed is:

1. A rotary electric component comprising:

a pair of cylindrical click pieces;

a U-shaped or ring-shaped spring, a center axis of the ring-shaped spring being parallel to a center axis of each of the cylindrical click pieces;

a rotatable plate having a recess configured to house the spring and notches formed such that each of the cylindrical click pieces is disposed in each of the notches respectively with two peripheral parts of the each of the cylindrical click pieces protrude from the each of the notches; and a housing that includes a projection and depression formed continuously in a circumferential direction of an inner perimeter of the housing and that is provided for the rotatable plate and the click pieces to be arranged, wherein:

the projection and depression of the housing are formed perpendicular to a rotation axis of the rotatable plate; and the cylindrical click pieces come into line contact with the projection and depression of the housing while the cylindrical click pieces are biased by the spring, thereby spreading out a force applied to the projection and depression, wherein one of the peripheral parts contacts with the projection and depression and the other one of the peripheral parts contacts with the spring.

2. The rotary electric component according to claim 1, wherein each of the cylindrical click pieces has a height smaller than a diameter of the each of the cylindrical click pieces.

3. The rotary electric component according to claim 1, wherein other notches are formed in the rotatable plate to assist in fitting the spring in the recess of the rotatable plate.

4. The rotary electric component according to claim 1, further comprising a rotationally-manipulated shaft, wherein the rotatable plate integrally rotates with the rotationally-manipulated shaft.

5. The rotary electric component according to claim 4, further comprising a switch configured to switch between terminals in accordance with a rotation angle of the rotationally-manipulated shaft.

6. A rotary electric component comprising:

a pair of cylindrical click pieces;

a U-shaped or ring-shaped spring, a center axis of the ring-shaped spring being parallel to a center axis of each of the cylindrical click pieces;

a rotatable plate having a recess configured to house the spring and notches formed such that each of the cylindrical click pieces is disposed in each of the notches respectively, a width of the notches being smaller than a diameter of the cylindrical click pieces; and a housing that includes a projection and depression formed continuously in a circumferential direction of an inner perimeter of the housing and that is provided for the rotatable plate and the click pieces to be arranged, wherein:

the projection and depression of the housing are formed perpendicular to a rotation axis of the rotatable plate; and the cylindrical click pieces come into line contact with the projection and depression of the housing while the cylindrical click pieces are biased by the spring, thereby spreading out a force applied to the projection and depression.

7. The rotary electric component according to claim 6, wherein each of the cylindrical click pieces has a height smaller than a diameter of the each of the cylindrical click pieces.

8. The rotary electric component according to claim 6, wherein other notches are formed in the rotatable plate to assist in fitting the spring in the recess of the rotatable plate.

9. The rotary electric component according to claim 6, further comprising a rotationally-manipulated shaft, wherein the rotatable plate integrally rotates with the rotationally-manipulated shaft.

10. The rotary electric component according to claim 9, further comprising a switch configured to switch between terminals in accordance with a rotation angle of the rotationally-manipulated shaft.

* * * * *